US011358691B2

(12) United States Patent
Kimpara

(10) Patent No.: US 11,358,691 B2
(45) Date of Patent: Jun. 14, 2022

(54) PROPELLER FOR BOAT PROPULSION APPARATUS

(71) Applicant: SUZUKI MOTOR CORPORATION, Hamamatsu (JP)

(72) Inventor: Masatoshi Kimpara, Hamamatsu (JP)

(73) Assignee: Suzuki Motor Corporation

( * ) Notice: Subject to any disclaimer, the term of this patent is extended or adjusted under 35 U.S.C. 154(b) by 120 days.

(21) Appl. No.: 16/796,520

(22) Filed: Feb. 20, 2020

(65) Prior Publication Data

US 2020/0324866 A1 Oct. 15, 2020

(30) Foreign Application Priority Data

Apr. 15, 2019 (JP) ..... JP2019-076884

(51) Int. Cl.
*B63H 1/20* (2006.01)
*B63H 1/26* (2006.01)

(52) U.S. Cl.
CPC ..... *B63H 1/20* (2013.01); *B63H 1/26* (2013.01)

(58) Field of Classification Search
CPC ..... B63H 1/20; B63H 1/26; B63H 20/007; B63H 1/15; B63H 20/32; B63H 20/34; B63H 5/07; B63H 5/08
See application file for complete search history.

(56) References Cited

U.S. PATENT DOCUMENTS 4,826,404 A * 5/1989 Zwicky ..... B63H 23/34 416/169 R
4,930,987 A * 6/1990 Stahl ..... B63H 1/20 416/219 A
5,049,034 A * 9/1991 Cahoon ..... B63H 20/245 416/500
6,176,680 B1 * 1/2001 Ringblom ..... 416/212 A
7,008,188 B2 * 3/2006 Booe, Jr. ..... B63H 1/15 416/134 R
2006/0263219 A1 * 11/2006 Dean ..... B63H 1/20 416/134 R

FOREIGN PATENT DOCUMENTS

JP 3055642 U 1/1999

* cited by examiner

*Primary Examiner* — Justin D Seabe
*Assistant Examiner* — Eric A Lange
(74) *Attorney, Agent, or Firm* — Barnes & Thornburg LLP

(57) ABSTRACT

To provide a propeller for a boat propulsion apparatus, which propeller is excellent in maintainability including easy assembly and easy disassembly and reliably reduces the impact force caused by colliding with an obstacle and transmitted to the hub and the output shaft of the boat propulsion apparatus. The propeller includes: a shaft sleeve insertably and removably fixed to an output shaft of the boat propulsion apparatus; a plurality of blade components that are individually supported by the shaft sleeve and are arranged at intervals in a rotation direction of the output shaft; and a plurality of dampers disposed in such a manner that each of the plurality of dampers is disposed between adjacent two of the plurality of blade components.

5 Claims, 6 Drawing Sheets

PROPELLER FOR BOAT PROPULSION APPARATUS

CROSS-REFERENCE TO RELATED APPLICATIONS

This application claims the benefit of priority of Japanese Patent Application No. 2019-076884, filed on Apr. 15, 2019, the entire contents of which are incorporated herein by reference.

BACKGROUND OF THE INVENTION

Field of the Invention

The present invention relates to a propeller for a boat propulsion apparatus.

Description of the Related Art

A known propeller includes: a hub that have a plurality of concaves on its outer peripheral edge; and a plurality of screw blades that have fitting portions to be fitted into the respective concaves along the axial direction of the hub.

[Patent Document 1] JP 3055642 U

In the technology of Patent Document 1, fitting accuracy at the fitting portions between the hub and the respective screw blades is desirably set in such a manner that the hub and the screw blades can be readily disassembled and reassembled even if the hub rusts or foreign matters enter the fitting portions between the hub and the screw blades.

A conventional propeller is provided with resin screw blades. When at least one screw blade collides with an obstacle, the resin screw blade is damaged and thereby the impact force propagating to the output shaft of a boat propulsion apparatus connected to the hub is buffered. In such a buffer mechanism, there is a possibility that the impact force may be transmitted to the hub and the output shaft of the boat propulsion apparatus depending on the fitting accuracy between the hub and the respective screw blades and looseness between both.

However, it is difficult to determine the fitting accuracy between the hub and the screw blades such that all the conditions of easy disassembly, easy reassembly, and buffering of impact force are satisfied.

SUMMARY OF THE INVENTION

To solve the problem described above, it is an object of the present invention to provide a propeller for a boat propulsion apparatus, which propeller is excellent in maintainability including easy assembly and easy disassembly and reliably reduces the impact force caused by colliding with an obstacle and transmitted to the hub and the output shaft of the boat propulsion apparatus.

To achieve the above object, an aspect of the present invention provides a propeller for a boat propulsion apparatus: a shaft sleeve insertably and removably fixed to an output shaft of the boat propulsion apparatus; a plurality of blade components that are individually supported by the shaft sleeve and are arranged at intervals in a rotation direction of the output shaft; and a plurality of dampers disposed in a manner that each of the plurality of dampers is disposed between adjacent two of the plurality of blade components.

According to a propeller for a boat propulsion apparatus of the present invention, it is easy to assemble and disassemble, excellent in maintainability, and reliably reduces the impact force caused by colliding with the obstacle and transmitted to the hub and the output shaft of the boat propulsion apparatus.

DETAILED DESCRIPTION

Hereinafter, embodiments of a propeller for a boat propulsion apparatus according to the present invention will be described by referring to FIG. 1 to FIG. 6. The same reference signs are given to identical or equivalent components in each figure.

In the following description, the "front" of the boat propulsion apparatus matches the forward direction of a watercraft in which the boat propulsion apparatus is mounted.

Figure 1:
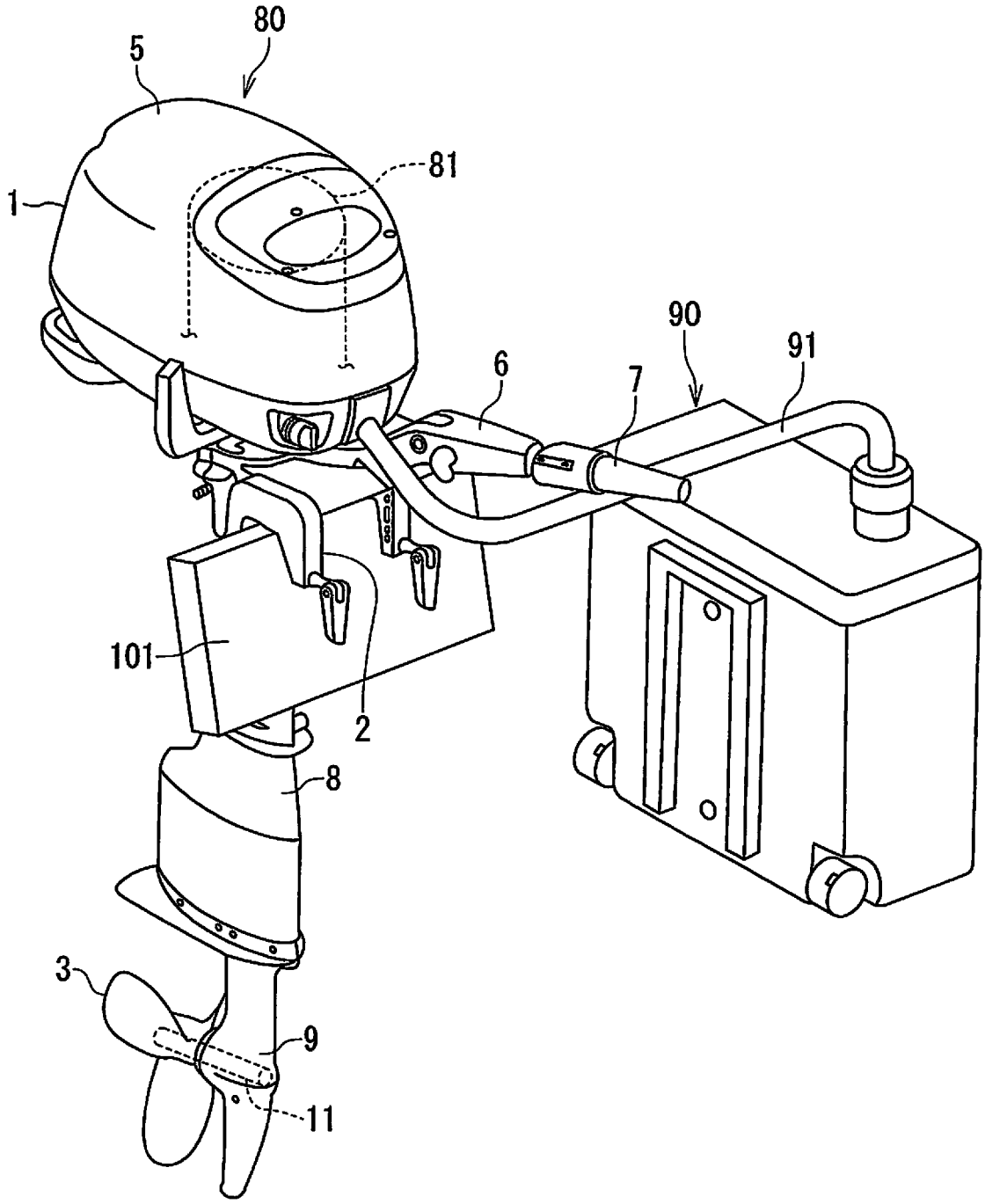
FIG. 1 is a perspective view of a boat propulsion apparatus that includes a propeller for the boat propulsion apparatus according to the present invention.
Figure 2:
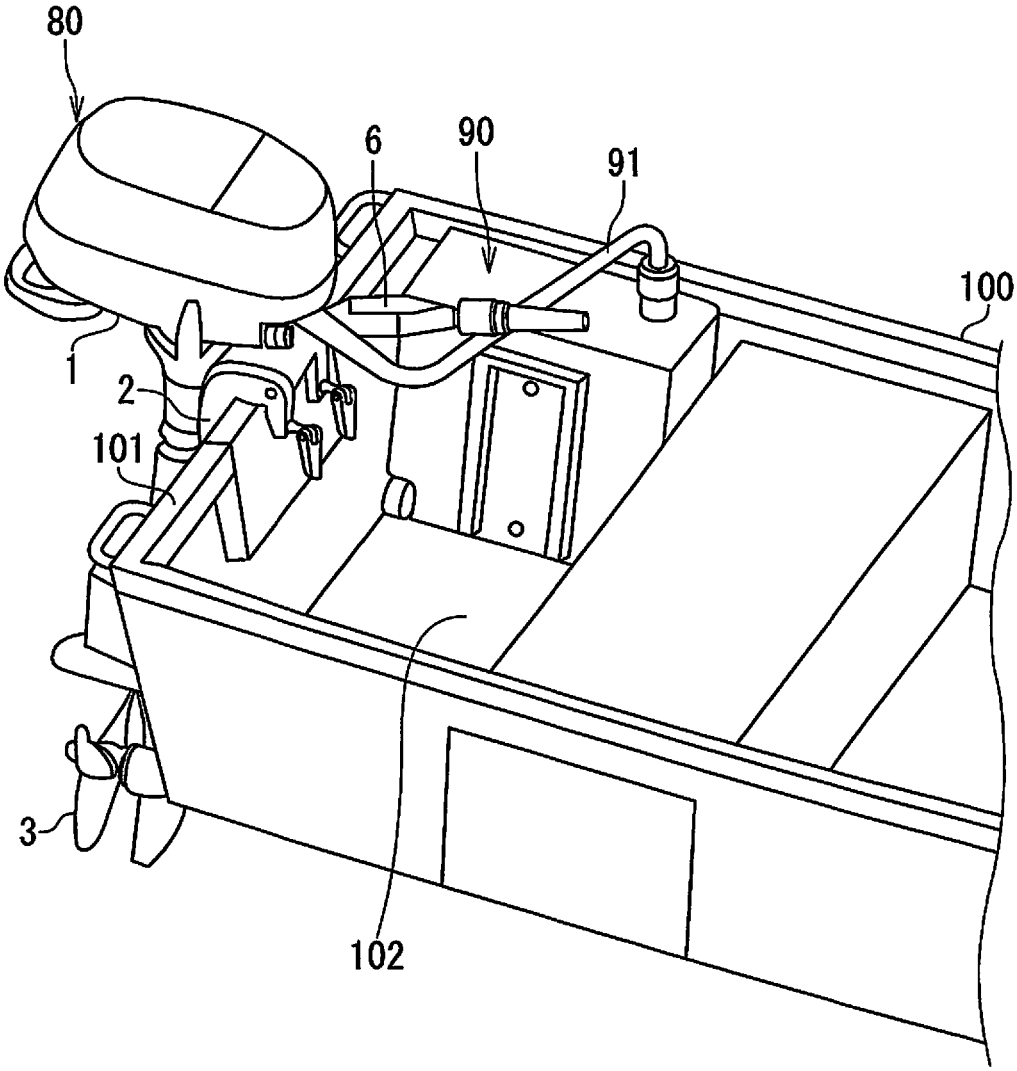
FIG. 2 is a perspective view of a watercraft provided with the boat propulsion apparatus that includes the propeller according to the present invention.
Figure 3:
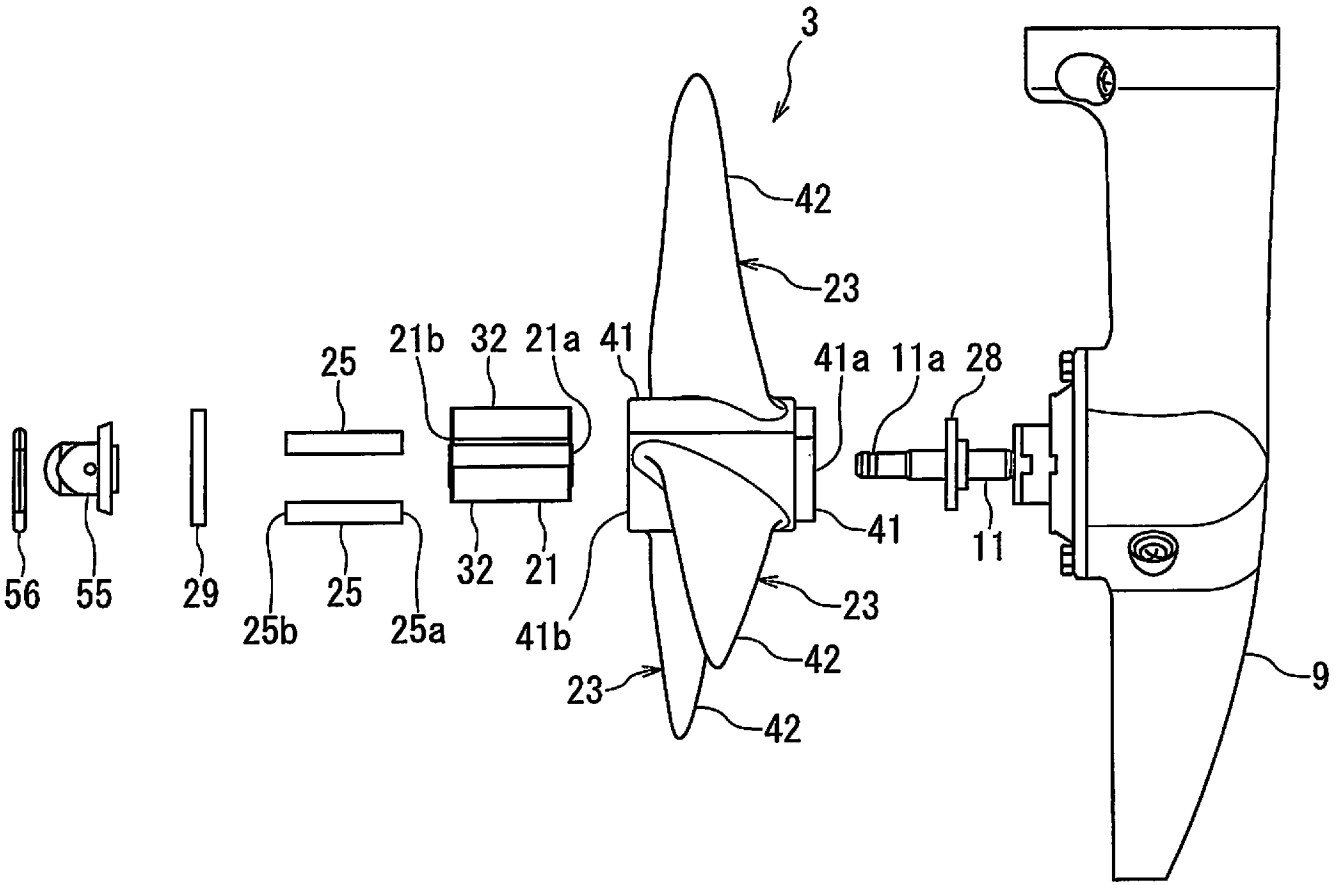
FIG. 3 is an exploded side view of the propeller according to the present invention.
Figure 4:
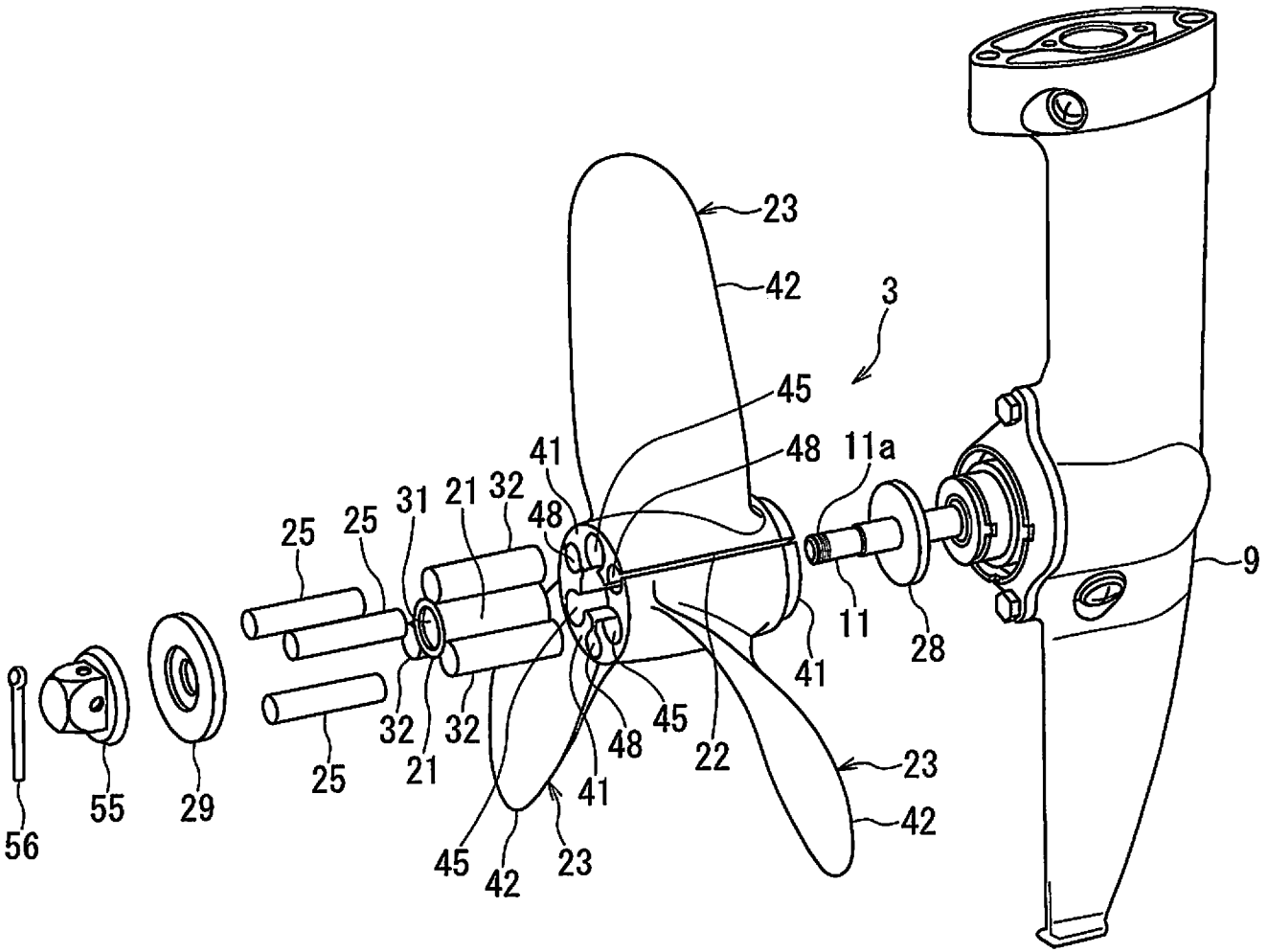
FIG. 4 is an exploded perspective view of the propeller according to the present invention.

As shown in FIG. 1, the boat propulsion apparatus according to the present embodiment is, for example, an electric outboard engine 80.

The electric outboard engine 80 includes an electric motor 81 as a drive source. The watercraft 100 is provided with a power supply device 90 that supplies electric power to the electric motor 81. The electric outboard engine 80 and the power supply device 90 are connected to each other via an external cable 91 that is also used for power supply and signal transmission.

The electric outboard engine 80 includes an outboard-motor main-body 1 and a mounting bracket 2. The mounting bracket 2 mounts or fixes the outboard-motor main-body 1 on the transom 101 of the watercraft 100.

The outboard-motor main-body 1 rotationally drives a propeller 3 disposed below the outboard-motor main-body 1 by the driving force of the electric motor 81 that is disposed at the upper portion of the outboard-motor main-body 1.

A motor cover 5 is provided on the top of the outboard-motor main-body 1. The electric motor 81 is accommodated in the motor cover 5.

A steering handle 6 is provided at the lower front portion of the motor cover 5. The steering handle 6 extends to the front of the motor cover 5. A slot grip 7 for adjusting the output of the electric motor 81 is provided at the tip of the steering handle 6. The steering handle 6 is provided with a shift switch (not shown) that switches between normal rotation and reverse rotation of the electric motor 81.

A drive shaft housing 8 is disposed below the motor cover 5. The drive shaft housing 8 extends downward from the motor cover 5. A gear case 9 is disposed at the lower portion of the drive shaft housing 8.

A drive shaft (not shown) is disposed inside the drive shaft housing 8. A propeller shaft 11 is disposed inside the gear case 9. The propeller shaft 11 is the output shaft of the boat propulsion apparatus. A propeller 3 is disposed at the rear end of the propeller shaft 11 so as to rotate integrally with the propeller shaft 11.

The driving force of the electric motor 81 is transmitted to the propeller 3 through the drive shaft and the propeller shaft 11. The driving force of the electric motor 81 causes the propeller 3 to rotate in the normal direction or in the reverse direction. The normal rotation of the propeller 3 is rotation that generates propulsive force to move the watercraft 100 forward, and the reverse rotation of the propeller 3 is rotation that generates propulsive force to move the watercraft 100 backward.

The mounting bracket 2 can hold the transom 101 of the watercraft 100. The mounting bracket 2 supports the outboard-motor main-body 1 such that outboard-motor main-body 1 can turn in the horizontal direction and in the front-rear direction with respect to the watercraft 100. Thus, the electric outboard engine 80 can tilt and trim by tilting the outboard-motor main-body 1 in the front-rear direction with respect to the watercraft 100. When the steering handle 6 is swiveled in the horizontal direction, the orientation of the outboard-motor main-body 1 with respect to the watercraft 100 is changed and thereby the travelling direction of the boat is changed to the right or left.

The power supply device 90 is installed on the deck 102 of the watercraft 100.

Next, the propeller 3 will be described in detail.

As shown in FIG. 3 to FIG. 6, the propeller 3 for the boat propulsion apparatus according to the present embodiment includes: a shaft sleeve 21 insertably and removably fixed to the propeller shaft 11 as the output shaft of the boat propulsion apparatus; a plurality of blade components 23 that are individually supported by the shaft sleeve 21, and are arranged at intervals (i.e., with gaps 22) in the rotation direction (i.e., radial direction) of the propeller shaft 11; and a plurality of dampers 25, each of which is provided between adjacent blade components 23. The number of the gaps 22 and the number of the dampers 25 are the same as the number of the blade components 23 (i.e., three in the case of FIG. 3 to FIG. 6).

The propeller 3 has a structure that can divide each of the blade components 23 independently. The propeller 3 has a fitting structure 26 in which the blade components 23 are individually fitted with or fitted into the shaft sleeve 21.

The propeller 3 includes a pair of positioning members 28 and 29 that positions the blade components 23 and the dampers 25 in the axial direction of the propeller shaft 11. The pair of positioning members 28 and 29 sandwich the blade components 23 and the dampers 25 together.

The shaft sleeve 21 has a center hole 31 into which the propeller shaft 11 is inserted. The shaft sleeve 21 includes a plurality of convex portions 32 that radially protrude in the radial direction of the propeller shaft 11. The number of the convex portions 32 is the same as the number of the blade components 23.

The center hole 31 is a spline groove hole that have a plurality of grooves extending in the axial direction of the shaft sleeve 21 and the grooves arranged at equal intervals in the circumferential direction of the shaft sleeve 21. The spline is, for example, an involute spline or a square spline. The center hole 31 is spline-fitted to the propeller shaft 11 that is a spline shaft.

Figure 6:
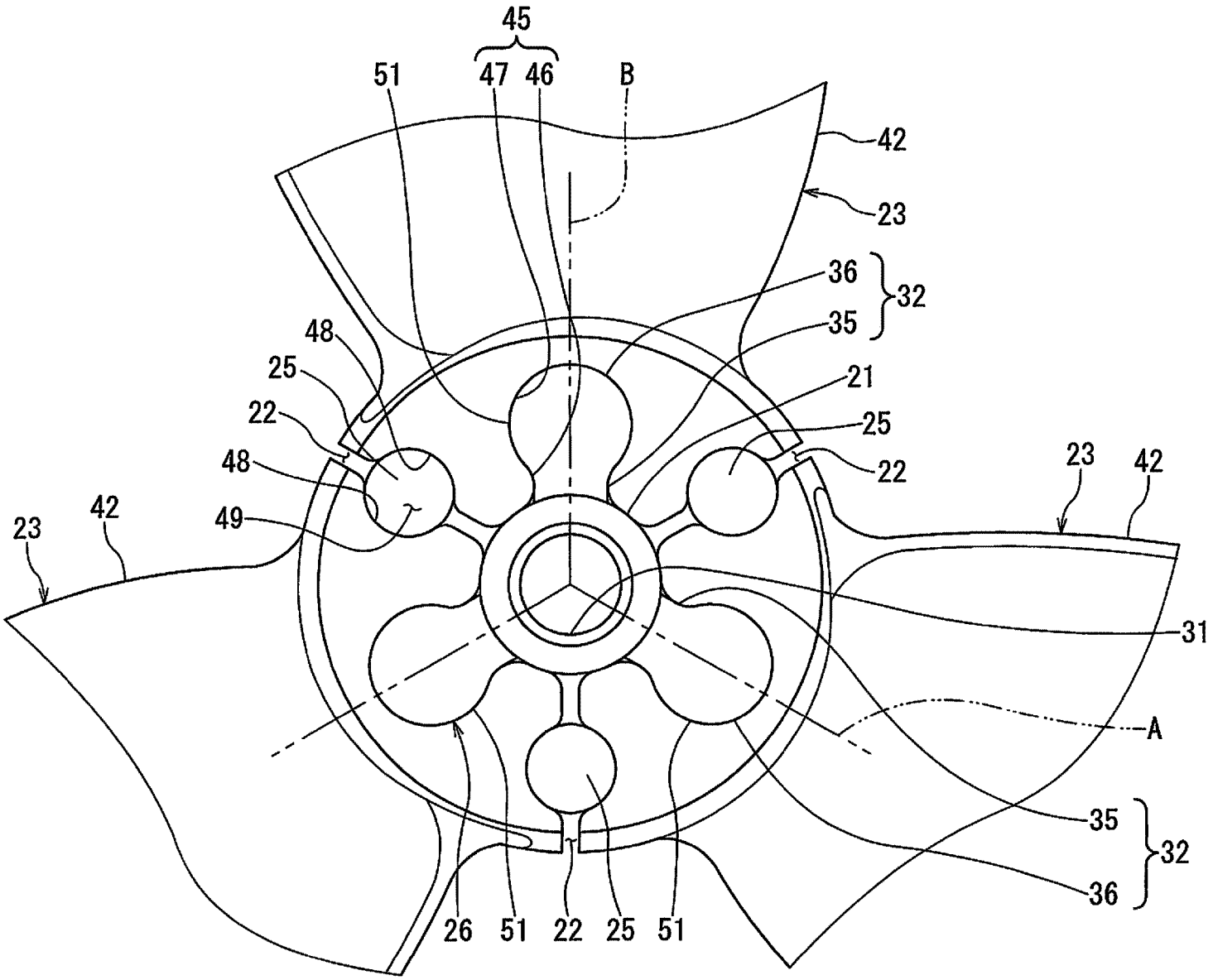
FIG. 6 is a partially enlarged view on the arrow X in FIG. 5 for illustrating the propeller according to the present invention.

The convex portions 32 are arranged at substantially equal intervals in the rotation direction of the propeller shaft 11. When there are three convex portions 32 as in the present embodiment, the convex portions 32 are arranged every 120 degrees surround the center line (i.e., rotation axis) of the shaft sleeve 21. As shown in FIG. 6, each of the convex portions 32 has line-symmetric shape with an imaginary straight-line A extending in the radial direction of the shaft sleeve 21 as the axis of symmetry. The axes of symmetry of the respective convex portions 32 are positioned every 120 degrees surround the center line of the shaft sleeve 21.

Each of the convex portions 32 is composed of an arm portion 35 protruding in the radial direction of the shaft sleeve 21 and a cylindrical portion 36 integrated with the protruding end of the arm portion 35. The arm portion 35 and the cylindrical portion 36 of each convex portion 32 extend in the axial direction of the propeller shaft 11 (i.e., in the extending direction of the propeller shaft 11). The arm portion 35 and the cylindrical portion 36 of each convex portion 32 extend from one end face to the other end face of the shaft sleeve 21. The diameter of each cylindrical portion 36 is larger than the thickness of each arm portion 35 in the direction orthogonal to the radial direction of the shaft sleeve 21.

The blade components 23 have substantially the same configuration and the same shape. The blade components 23 are arranged at equal intervals in the circumferential direction of the shaft sleeve 21. Accordingly, when there are three blade components 23 as in the present embodiment, the blade components 23 having the same shape are provided every 120 degrees surround the center line of the shaft sleeve 21.

Figure 5:
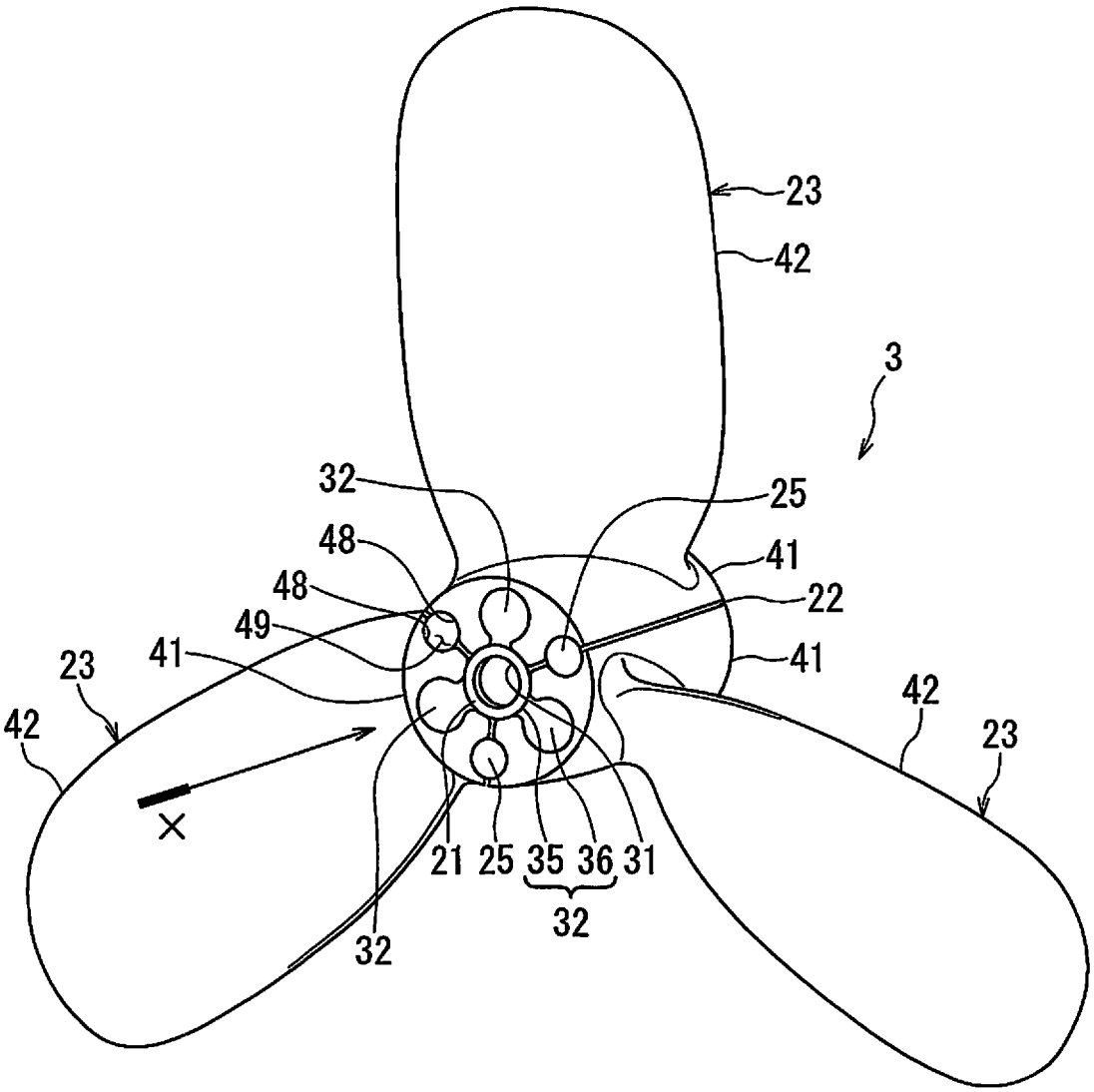
FIG. 5 is a perspective view of the propeller according to the present invention.

As shown in FIG. 5, each of the blade components 23 is composed of an arc portion 41 and a blade element 42 that protrudes from the arc portion 41.

The shape of the arc portion 41 as viewed from the axial direction of the propeller shaft 11 is a shape obtained by cutting out a ring in a fan shape. The arc portion 41 has an arcuate wall shape. The central angle of each arc portion 41 is equal to the angle that is obtained by dividing 360 degrees by the total number of the blade components 23. Thus, when there are three blade components 23 as in the present embodiment, the central angle of each arc portion 41 is set to 120 degrees. Each arc portion 41 has a column shape extending in the axial direction of the propeller shaft 11. In appearance, each arc portion 41 has: a first end face 41*a* near the root of the propeller shaft 11; a second end face 41*b* near the free end of the propeller shaft 11; an inner peripheral face facing the shaft sleeve 21; an outer peripheral face provided with the blade element 42; and two side faces, each of which faces the arc portion 41 of the adjacent blade component 23.

The inner peripheral face of each arc portion 41 is provided with a concave portion 45 with which one convex portion 32 of the shaft sleeve 21 can be fitted. As shown in FIG. 6, each concave portion 45 has line-symmetric shape with a bisector B of the central angle of the arc portion 41 as the axis of symmetry.

Each concave portion 45 includes: a uniform-width groove 46 into which the arm portion 35 of one convex portion 32 can be fitted; and a circular groove 47 into which the cylindrical portion 36 of one convex portion 32 can be fitted. Each concave portion 45 extends from the first end surface 41*a* to the second end surface 41*b* of each arc portion 41. The convex portions 32 of the shaft sleeve 21 are fitted with the respective concave portions 45 so as to be inserted into the respective concave portions 45 from the sides of the respective first end faces 41*a* of the arc portions 41.

A damper groove 48 having an arc-shaped cross-section is provided on both side faces of each arc portion 41. The total number of the damper grooves 48 is twice the total number of the blade components 23. The cross-sectional shape of each damper groove 48 is slightly shallower than the semi-circular arc. That is, the depth of each damper groove 48 is smaller than the radius of curvature. The center of curvature of each damper groove 48 is positioned in the gap 22 between adjacent two arc portions 41. The chord of the arcuate damper groove 48 is smaller than twice the radius of curvature. Each pair of the damper grooves 48 between two adjacent blade components 23 face each other to form a substantially circular damper insertion space 49 such that the total number of the damper insertion space 49 is the same as the total number of the blade components 23.

The plurality of arc portions 41 form a ring surrounding the periphery of the shaft sleeve 21 with the plurality of blade components 23 as a whole. The shaft sleeve 21, the plurality of arc portions 41 surrounding the shaft sleeve 21 in an annular shape, and the plurality of dampers 25 correspond to a hub of the propeller 3.

Each gap 22 is provided between two adjacent arc portions 41 of respective two adjacent blade components 23 as shown in FIG. 5. The number of the gaps 22 is the same as the number of the blade components 23. In detail, each gap 22 is provided between one side face of one of the two adjacent arc portions 41 and one side face of the other of the two adjacent arc portions 41. Each gap 22 extends from one end face to the other end face of each blade component 23 in the radial direction of the propeller shaft 11 while maintaining a predetermined interval between adjacent two blade components 23. The width of each of gaps 22 is substantially the same. The gaps 22 are arranged at substantially equal intervals in the rotation direction of the propeller shaft 11. When there are three blade components 23 as in the present embodiment, the gaps 22 are arranged surround the center line of the shaft sleeve 21 every 120 degrees.

The total number of the damper insertion spaces 49 is the same as the number of the blade components 23 (i.e., same as the number of the gaps 22), and the damper insertion spaces 49 are arranged at substantially equal intervals in the rotation direction of the propeller shaft 11 similarly to the blade components 23. That is, each gap 22 includes one damper insertion space 49. When there are three blade components 23 as in the present embodiment, the damper insertion spaces 49 are arranged every 120 degrees surround the center line of the shaft sleeve 21.

Each damper 25 is made of vibration-proof rubber, for example. Each damper 25 is disposed in the corresponding gap 22. More specifically, each damper 25 is provided in the corresponding damper insertion space 49. Each damper 25 has a columnar shape parallel to the center line of the shaft sleeve 21.

The dampers 25 are arranged at substantially equal intervals in the rotation direction of the propeller shaft 11. When there are three blade components 23 as in the present embodiment, the dampers 25 are arranged every 120 degrees surround the center line of the shaft sleeve 21.

The fitting structure 26 includes: the convex portions 32 of the shaft sleeve 21; and the concave portion 45 of the respective blade components 23. The fitting structure 26 includes the same number of fitting portions 51 as the number of blade components 23, and the blade components are fitted into the shaft sleeve 21 via the respective fitting portions 51. In other words, the fitting structure 26 includes: the convex portions 32 that are provided in the respective fitting portions 51 and have a columnar shape in parallel with the center line of the shaft sleeve 21; and the concave portions 45 that can be fitted into the respective convex portions 32. The blade components 23 are individually fitted with and supported by the shaft sleeve 21 at the respective fitting portions 51. The fitting portions 51 are arranged at substantially equal intervals in the rotation direction of the propeller shaft 11.

Each convex portion 32 is fitted into the corresponding concave portion 45 with a clearance fit. That is, the convex portions 32 can be readily inserted into and removed from the respective concave portions 45. The gap formed between each convex portion 32 and the corresponding concave portion 45 allows the blade components 23 to move in the rotational direction of the propeller 3 with respect to the convex portions 32.

Each damper 25 is fitted into the corresponding damper insertion space 49 with a tight fit. The respective dampers 25 fitted tightly hold the movement of the blade components 23 in the rotational direction of the propeller 3 with respect to the convex portions 32. As a result, even if an obstacle collides the propeller 3 and impact force is generated, the dampers 25 absorb the impact force.

The blade components 23 and the shaft sleeve 21, both of which can be readily fitted with each other, are held using the dampers 25 fitted into the respective damper insertion spaces 49 with tight fits such that the blade components 23 and the shaft sleeve 21 are not readily disassembled.

The arrangement relationship between the convex portions 32 and the concave portions 45 may be reversed. That is, the propeller 3 may be configured such that the concave portions 45 are provided in the shaft sleeve 21 and the convex portions 32 are provided on the blade components 23.

Each damper 25 is disposed at the intermediate position between adjacent two fitting portions 51. That is, the dampers 25 and the fitting portions 51 are alternately arranged at equal intervals in the rotation direction of the propeller shaft 11. When there are three dampers 25 and three fitting portions 51 as in the present embodiment, the dampers 25 and the fitting portions 51 are alternately arranged every 60 degrees in the rotation direction of the propeller shaft 11. In other words, in the direction of the center line of the shaft sleeve 21, each of the dampers 25 is arranged on a bisector of an angle formed by a pair of adjacent fitting portions 51 with the center of the shaft sleeve 21 as a vertex. Each of the fitting portions 51 is arranged on a bisector of an angle formed by a pair of adjacent dampers 25 with the center of the shaft sleeve 21 as a vertex defined in a similar manner as described above.

Fitting centers between concave portions 45 and the corresponding convex portions 32 are positioned on the circle, and the center of which is the axial center of the shaft sleeve 21. The fitting center between each concave portions 45 and the corresponding convex portions 32 is the center of the cylindrical portion 36 of the corresponding convex portions 32 or the center of the circular groove 47 of the corresponding concave portion 45.

Centers of the respective dampers 25 are positioned on the circle, and the center of which is the axial center of the shaft sleeve 21.

The circle on which the fitting centers are positioned is not necessarily required to match the circle on which the centers of the respective dampers 25 are positioned.

In the present embodiment, the circle on which the fitting centers are positioned matches the circle on which the centers of the respective dampers 25 are positioned. That is, the circle on which the fitting centers are positioned and the circle on which the centers of the respective dampers 25 are positioned are concentric circles or the same circle.

The first positioning member 28 is disposed near the base (root) of the propeller shaft 11. The first positioning member 28 has a spline hole and is fitted into the spline of the propeller shaft 11.

The second positioning member 29 is disposed near the free end of the propeller shaft 11. The second positioning member 29 is a washer that is sandwiched between the propeller 3 and the nut 55 for fixing the propeller 3 to the propeller shaft 11. The second positioning member 29 transmits the tightening force of the nut 55 to the propeller 3 so as to press the propeller 3 sandwiched between the first and second positioning members 28 and 29 against the first positioning member 28.

The first positioning member 28 is in contact with the first end face 21*a* near the base (root) of the propeller shaft 11 of the shaft sleeve 21. The second positioning member 29 is in contact with the second end face 21*b* near the free end of the propeller shaft 11 of the shaft sleeve 21. The first positioning member 28 has a diameter by which the first positioning member is in contact with the first end face 21*a* of each convex portion 32 of the shaft sleeve 21 and the first end face 25*a* of each damper 25. The second positioning member 29 has a diameter by which the second positioning member 29 is in contact with the second end face 21*b* of each convex portion 32 of the shaft sleeve 21 and the second end face 25*b* of each damper 25. Thus, the first and second positioning members 28 and 29 sandwiching both end faces of the shaft sleeve 21 prevent the blade components 23 and the dampers 25 from moving in the axial direction of the propeller shaft 11 and being separated from the shaft sleeve 21.

The nut 55 is fastened to a screw portion 11*a* provided at the free end portion of the propeller shaft 11. A cotter pin (or split pin) 56 is inserted to pass through the nut 55 and the screw portion 11*a* in the radial direction of the propeller shaft 11, and thus the nut 55 is prevented from loosening and coming off.

The propeller (for a boat propulsion apparatus) according to the present invention are not limited to the outboard motor in the above-described embodiment but include all the drive sources that provide propulsion to the watercraft including a boat and a ship.

As described above, the propeller 3 for the boat propulsion apparatus according to the present embodiment includes: the shaft sleeve 21 insertably and removably fixed to the propeller shaft 11; the blade components 23 that are individually supported by the shaft sleeve 21, and are arranged in the rotation direction of the propeller shaft 11 with each gaps 22 between adjacent blade components 23; and the dampers 25, each of which is provided between two adjacent blade components 23. Consequently, even if the blade components 23 made of resin material with less fitting accuracy than the blade components 23 made of metal material are adopted for the propeller 3, the propeller 3 can ensure predetermined performance and can be assembled by the dampers 25, each of which is sandwiched between adjacent blade components 23.

In addition, even if the fitting accuracy between the shaft sleeve 21 and the blade components 23 is unsatisfactory, the propeller 3 can absorb this inaccuracy so as to exhibit satisfactory performance.

Further, when an obstacle collides with the blade elements 42 and impact is generated on the propeller 3, the propeller 3 can also buffer the impact with the dampers 25.

Moreover, the propeller 3 has an assembly structure in which only the specific blade element 42 can be replaced independently when a problem occurs in this specific blade element 42. Thus, the propeller 3 has extremely high maintainability and serviceability, and improves user convenience. Specifically, the propeller 3 can be readily assembled and disassembled by moving the shaft sleeve 21, the blade components 23, and the dampers 25 in the axial direction of the propeller shaft 11. The propeller 3 having such an extremely simple structure can be readily disassembled and maintained even if rust occurs and resistance increases in the fitting structure 26.

Furthermore, the propeller 3 can reduces the looseness or backlash at the fitting portion between the shaft sleeve 21 and the blade components 23 by an elastic deformation of the dampers 25. This improves the manufacturability of the propeller 3, reduces the cost of the propeller 3, and reduces noise caused by rotation of the propeller 3.

Additionally, the propeller 3 for the boat propulsion apparatus according to the present embodiment includes the dampers 25, each of which is disposed at the intermediate position between the adjacent two fitting portions 51. Consequently, the propeller 3 can be assembled with the blade components 23 having the same configuration and the same shape, and the damper 25 having the same configuration and the same shape. The propeller 3 can obtain satisfactory balance as a rotating body, and reduce rotational imbalance.

Further, the propeller 3 for the boat propulsion apparatus according to the present embodiment includes: the convex portions 32 having a column shape in parallel with the center line of the shaft sleeve 21; the concave portions 45 that can be fitted into the respective convex portions; and the dampers 25 having a columnar shape in parallel with the center line of the shaft sleeve 21. Consequently, the propeller 3 can evenly arrange the blade components 23 having the same configuration and the same shape in an easy manner.

Moreover, the propeller 3 for the boat propulsion apparatus according to the present embodiment includes: the fitting portions 51 arranged on the circle, and the center of which is positioned on the axial center of the shaft sleeve 21; and the dampers 25 arranged on the circle, and the center of which is positioned on the axial center of the shaft sleeve 21. consequently, the propeller 3 can regularly arrange the blade components 23 having the same configuration and the same shape in an easy manner.

Furthermore, the propeller 3 for the boat propulsion apparatus according to the present embodiment includes the pair of positioning members 28 and 29 that sandwich the blade components 23 and the dampers 25 together so as to position the blade components 23 and the dampers 25 in the axial direction of the propeller shaft 11. consequently, the propeller 3 can be assembled and disassembled very easily by moving the shaft sleeve 21, the blade components 23, and the damper 25 in the axial direction of the propeller shaft 11.

As described above, the propeller 3 for the boat propulsion apparatus according to the present embodiment is excellent in maintainability including easy assembly and easy disassembly and reliably reduces the impact force caused by colliding with an obstacle and transmitted to the propeller shaft 11 of the electric outboard engine 80 and the shaft sleeve 21.

What is claimed is:

1. A propeller for a boat propulsion apparatus comprising:

a shaft sleeve insertably and removably fixed to an output shaft of the boat propulsion apparatus;

a plurality of blade components that are individually supported by the shaft sleeve and are arranged at intervals in a rotation direction of the output shaft;

a plurality of dampers disposed in such a manner that each of the plurality of dampers is disposed between adjacent two of the plurality of blade components; and a fitting structure that individually fits the plurality of blade components with the shaft sleeve, wherein a plurality of fitting portions between the shaft sleeve and the plurality of blade components are arranged at equal intervals in the rotation direction of the output shaft, and each fitting portion has line-symmetric shape with a bisector of the central angle of the respective blade component as the axis of symmetry, wherein each of the plurality of dampers is disposed at an intermediate position between adjacent two of the plurality of fitting portions, wherein the fitting structure includes a plurality of convex portions that are provided at the respective fitting portions and in a shape of a column in parallel with a central axis of the shaft sleeve, and a plurality of concave portions that can be individually fitted with the respective convex portions, wherein the plurality of dampers that have a columnar shape in parallel with the central axis of the shaft sleeve, and wherein the number of the dampers, the number of the blade components, the number of the convex portions, the number of the concave portions, and the number of the intervals are the same.

2. The propeller for a boat propulsion apparatus according to claim 1, wherein:

each of fitting centers between the plurality of concave portions and the respective convex portions is positioned on an imaginary circle centered on an axial center of the shaft sleeve; and each of centers of the plurality of dampers is positioned on an imaginary circle centered on the axial center of the shaft sleeve.

3. The propeller for a boat propulsion apparatus according to claim 1, further comprising a pair of positioning members that sandwich the plurality of blade components and the plurality of dampers together and position the plurality of blade components and the plurality of dampers on the output shaft.

4. The propeller for a boat propulsion apparatus according to claim 2, further comprising a pair of positioning members that sandwich the plurality of blade components and the plurality of dampers together and position the plurality of blade components and the plurality of dampers on the output shaft.

5. The propeller for a boat propulsion apparatus according to claim 1, wherein each of the convex portions includes an arm portion protruding in the radial direction of the shaft sleeve, and a cylindrical portion integrated with the protruding end of the arm portion.

* * * * *